US007316364B2

(12) United States Patent
Larsen

(10) Patent No.: US 7,316,364 B2
(45) Date of Patent: Jan. 8, 2008

(54) SHOWER HEAD

(75) Inventor: Finn Thv. Larsen, Oslo (NO)

(73) Assignee: Biobe AS, Krakeroy (NO)

( * ) Notice: Subject to any disclaimer, the term of this patent is extended or adjusted under 35 U.S.C. 154(b) by 278 days.

(21) Appl. No.: 10/520,398

(22) PCT Filed: Jul. 4, 2003

(86) PCT No.: PCT/NO03/00237

§ 371 (c)(1),
(2), (4) Date: Sep. 30, 2005

(87) PCT Pub. No.: WO2004/004915

PCT Pub. Date: Jan. 15, 2004

(65) Prior Publication Data

US 2006/0151632 A1 Jul. 13, 2006

(30) Foreign Application Priority Data

Jul. 5, 2002 (NO) ..... 20023274

(51) Int. Cl.

| | |
|---|---|
| ***A62C 31/02*** | (2006.01) |
| ***B05B 1/00*** | (2006.01) |
| ***B05B 7/02*** | (2006.01) |
| ***B05B 1/26*** | (2006.01) |

(52) U.S. Cl. ..... 239/589; 239/525; 239/461; 239/480; 239/482; 239/569; 239/570; 239/469

(58) Field of Classification Search ..... 239/589, 239/525, 461, 480, 482, 569, 570, 469
See application file for complete search history.

(56) References Cited

U.S. PATENT DOCUMENTS 3,847,178 A 11/1974 Wolf-Dieter
3,856,206 A * 12/1974 Bell et al. ..... 239/75
4,000,857 A 1/1977 Moen
4,161,965 A 7/1979 Merritt (Continued)

FOREIGN PATENT DOCUMENTS

EP 1123743 A1 8/2001

(Continued)

*Primary Examiner*—Davis Hwu
(74) *Attorney, Agent, or Firm*—Osha Liang LLP

(57) ABSTRACT

A shower head includes a mouth piece including a middle axial through channel for flow through of water, a rotationally symmetrical deflection element for the water being near the external outlet of the channel, which mouth piece is connected to a holder through which the water is fed, while the deflection element is held by a stem which with radial clearance projects axially in the channel, and is surrounded by a conical surface, the mouth piece limiting a cavity around and axially outside the deflection element, the conical surface projecting convergently outwardly. The stem may be conical at least in the portion being furthest away from the deflection element, whereby the surface of the stem converges towards the deflection element, and whereby the flow area for the water between the stem and the mouth piece is altered by axial movement of the mouth piece relatively to the holder. The stem is secured in an insert mounted in the holder, and a regulator for causing an approximately constant amount of water per time at variations of the water pressure is mounted in the area at the inert, or possibly integrated therein.

4 Claims, 3 Drawing Sheets

U.S. PATENT DOCUMENTS

| | | | |
|---|---|---|---|
| 4,244,526 | A | 1/1981 | Arth |
| 4,275,843 | A | 6/1981 | Moen |
| 4,562,960 | A | 1/1986 | Marty et al. |
| 5,685,489 | A | 11/1997 | Larsen |

FOREIGN PATENT DOCUMENTS

| | | | |
|---|---|---|---|
| GB | 1542849 | A1 | 3/1979 |

* cited by examiner

SHOWER HEAD

BACKGROUND OF THE INVENTION

The present invention relates to a shower head comprising a mouth piece including a middle axial through channel for flow through of water, a rotationally symmetrical deflection element for the water being near the external outlet of the channel, which mouth piece is connected to a holder through which the water is fed, while the deflection element is held by a stem which with radial clearance is projecting axially in the channel, and is surrounded by a conical surface, the mouth piece limiting a cavity around and axially outside the deflection element, the conical surface projecting convergently outwardly, the stem being secured in an insert in the holder, which insert has at least one through opening for leading the water to the channel.

Such a shower head is known from the Norwegian Patent No. 177256, which also shows a mouth piece which may be axially adjusted relatively to the holder.

For many years there has been developed shower heads with the intention of low water consumption ("economy showers"), in the range of 6-10 l/min. This consumption is usually based on normal water pressures, which are about 200 to 500 kPa. Since the water consumption hence already is at "economy level" at such normal pressures, lower pressure will cause that the consumption will be less than desirable. The water consumption is reduced to below the "comfort level" and creates negative attitudes towards such shower heads.

Shower heads which may give pulsating showers have been known for a long time. These are based on the use of a rotor similar to a propeller inside the shower head. Such shower heads may normally be adjusted between normal state for smooth shower of water and the pulsating shower of water. Such shower heads are normally constructed for high water consumption and normal water pressure, and they are complicated.

By the development of shower heads for low water consumption, the objective has in some cases been to obtain the low consumption, without taking into account the consequences with respect to effect, comfort and structure of the water that flows out of the shower head. This has, on one hand, in most cases caused low water velocities and a not very favourable water structure, and, on the other hand, constructions which may cause clogging due to impurities or lime in the water or which are based on the jet/air flow principle.

The Norwegian Patent No. 177256 describes a shower head which gives low water consumption at normal water pressure, which reduces the shower comfort at low water pressures to a less degree than some other "economy showers", and which may be adjusted between a normal state for showering and a state for pulsating showering ("massage showering"), the latter state being obtained without any rotating member in the shower head.

The construction of the shower head causes that the water in all phases is sent out in pulses with frequency 20-40 $s^{-1}$, depending on the pressure.

This is obtained due to the water exiting pulsatorily out of the section outermost at the convergent stem, close to the deflection element. This way a less amount of water is flowing out over time than with continuous flow of water, and "saving" is obtained.

The patent shows a mouth piece which may be screwed axially relatively to the holder, for changing of the flow conditions. Moreover, the stem is conical and is converging towards the deflection element. When the mouth piece is screwed approximately maximally into the holder, and hence the deflection element being approximately furthest away from the channel outlet, relatively large water drops are formed with relatively great mutual distance and great velocity, and which leave the deflection element in a conical surface. Some of the water hits the wall in the cavity, and the water is reflected off the wall and leaves the mouth piece, and forms a fairly uniform structure.

When the mouth piece is screwed further out axially relatively to the holder, whereby the deflection element is closer to the channel outlet, there will be an increased choking at the deflection element, but this position is suitable for low water pressures, since higher water velocities which feel comfortable and effective are obtained.

When the mouth piece is screwed approximately to its end position away from the holder, and hence the deflection element being in maximum proximity of the mouth piece, the water is gathered in a uniform mass, and full effectivity of the "splitting" of the water is obtained, so that the massage function with "impact effect" of the water is obtained.

That the surface surrounding the deflection element mainly is conical and converges outwardly from the bottom surface in the mouth piece, is significant for the outflow course of the water around the deflection element.

That the stem is conical has a direct influence on the flow area of the water uppermost in the channel. This flow area will be smallest when the mouth piece is screwed maximally into the holder. Simultaneously, the deflection element is in its largest distance from the channel outlet. Hence, most of the choking will appear uppermost in the channel. The effect is the above mentioned relatively large drops of water. On the other hand, when the mouth piece is screwed maximally out relatively to the holder, this flow area is at its largest. Simultaneously, the deflection element is in its smallest distance from the channel. Hence, most of the choking will appear at the deflection element. This permits an acceptable water velocity and improved comfort with low pressure in the supplied water as well.

In the patent, the stem is shown screwed into a boss integral with the holder through which the water is fed. The water flows around the boss and alongside the stem. In practice, it has proved that there should be maintained great accuracy regarding the aligning of the stem in the holder, as the deflection element at the free end of the stem is to cooperate with the mouth piece. A small angle error in the fastening of the stem in the boss may lead to a considerable wrong location of the deflection element relatively to the mouth piece, because the deflection element becomes eccentric relatively to the mouth piece. It is also advisable to be able to produce shower heads having mutually different characteristics regarding the flow of water, but without having to make modifications in the holder or the mouth piece, which usually will be cast of plastic.

One solution which simplifies and secures the aligning of the stem and which also makes it possible to produce slightly different shower heads, is described in Norwegian Patent Application No. 1998 0820, and comprises that the stem is fastened in an adapter which is mounted in the holder, which adapter has at least one axially through opening for conducting water to the channel. The opening or each opening may be in the form of a groove in the external surface of the adapter or a hole through the adapter. Exclusively by producing different adapters, shower heads with different characteristics regarding the flow of water may be produced. The grooves or holes cause a stabilization of the water before it enters the channel.

In this known solution, the stabilization unit is not adjustable, and the amount of water flowing through the shower head will vary with the water pressure, in such a way that the amount of water will increase with increasing pressure.

Under some conditions it is desirable that the amount of water flowing through the shower head is as constant as possible, regardless of pressure, when this is within reasonable limits.

For conventional shower heads there has been used a regulator causing a choking of the water in such a way that the choking is increasing with increasing water pressure. The regulator has been mounted at the inlet of the shower head, i.e. where the hose (or a supply conduit for fixed shower heads) is connected to the shower head. It has e.g. been used a sleeve in which the regulator has been mounted, and which is inserted as a transition between the hose or the conduit for water supply and the shower head. The regulator itself has been formed as an annulus member with axial openings and a cylindrical or conical part with axial grooves, combined with an O-ring which surrounds the grooves and is held in place by an auxiliary ring, and which acts in such a manner that the O-ring is deformed progressively with increasing water pressure and increasingly intrudes into the grooves in the ring member, whereby the flow area decreases. Hence, it may be obtained an approximately constant amount of water per time unit at water pressures from about 50 to about 1000 kPa. The amount of water will of course be dependent on the geometry of the regulator, such as the cross section of the grooves and the dimensions of the O-ring, and experiments are necessary to find the geometry that gives a desired amount of water per time unit.

The location of the regulator at the inlet of the shower head, i.e. at the end of the handle thereof or lowermost at a shower head mounted on the wall, causes the regulator to normally be under water when the shower head is not in use. If the water flows away, there will still remain water in the holes in the regulator due to the surface tension. Lime in the water will little by little settle and gradually block the holes. These small holes also reduce the supply of light and oxygen inwardly in the shower head, which amplifies the formation of "hard" lime, as opposed to "pulverized" lime which is formed by supply of light and oxygen, and which is easily flushed away. Hence, the amount of water per time unit may be reduced to below what the users find acceptable.

Some places there are introduced maximum limits for the water consumption during showering. However, many quantity limiters which have been used do not supply approximately constant amount of water per time unit when the pressure varies, and reduce the amount of water per time unit at low pressures to below what is acceptable. The above mentioned regulators improve this condition, but are burdened with the mentioned deficiencies regarding the lime deposit and the formation of "hard" lime.

With the present invention there is provided a solution which both causes approximately constant amount of water per time unit and which to a large degree avoids the problems of lime deposit, and which due to the "amplification effect" gives increased comfort.

SUMMARY OF THE INVENTION

The shower head according to the invention appears from the following claim 1.

According to the invention, the regulator is in the area of the insert or is integrated therein. After the shower head has been used, the water will normally flow towards the hose or the conduit for water supply. Oxygen in the air which enters the shower head causes the lime that deposits to be of the "pulverized" type that easily is flushed away at the next time of use.

The mouth piece and the stem may be fixedly mounted relatively to each other, whereby the shower head may not be adjusted regarding the cooperation between the mouth piece, the stem and the deflection element. However, in a preferred embodiment, the stem is conical at least in the portion that is furthest away from the deflection element, whereby the surface of the stem converges towards the deflection element, and whereby the flow area for the water between the stem and the mouth piece is altered by moving the mouth piece axially relatively to the holder by screwing, similar as shown in Norwegian Patent No. 177256.

The invention will in the following be explained more detailed, by means of embodiments shown in the accompanying drawings.

DETAILED DESCRIPTION

The figures show examples of shower heads according to the invention, in a sectional view axially through the centre of the mouth piece. The scale in the figures is approximately 1.5:1.

The embodiments are described partially all in one.

Figure 1:
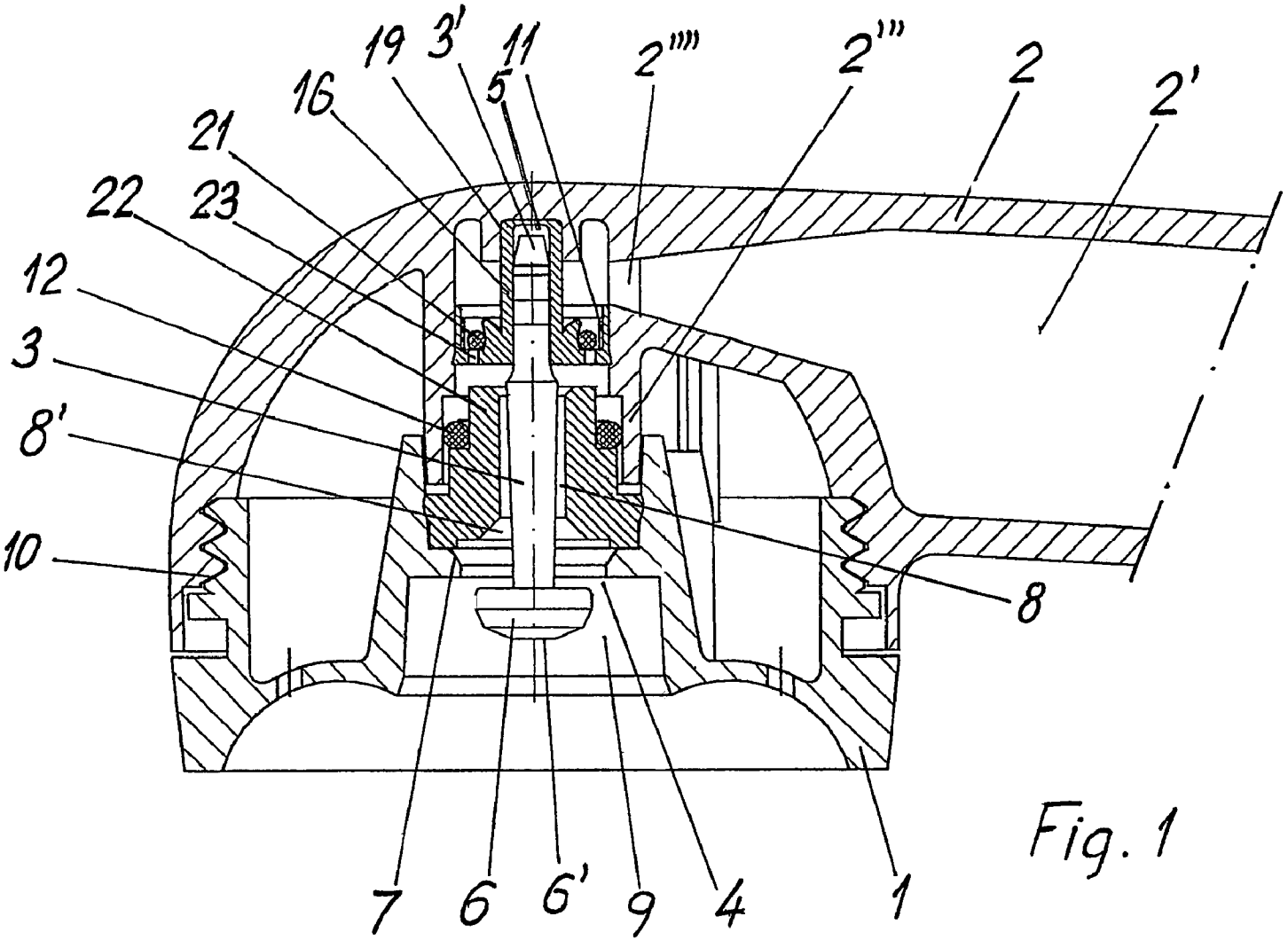
FIG. 1 shows a sectional view of an embodiment where the insert and the regulator are mounted in a sleeve which constitutes an integrated part of a holder which forms a handle.
Figure 2:
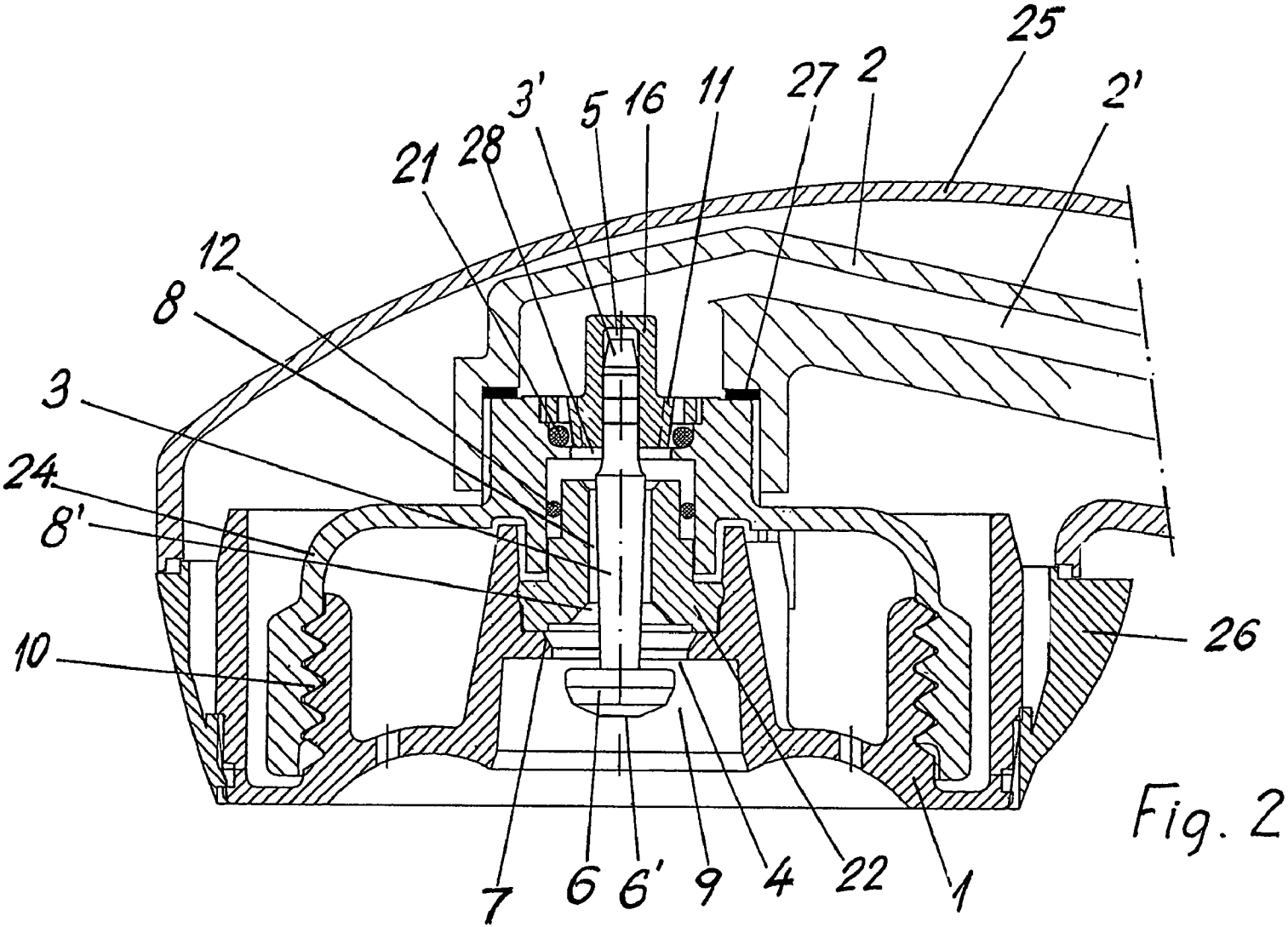
FIGS. 2 and 3 show sectional views of embodiments in which there is used an adapter between the mouth piece and a holder, the holder being inside an encasing which also constitutes a handle. The insert with the regulator is screwed into a sleeve which constitutes an integrated part of the adapter.
Figure 3:
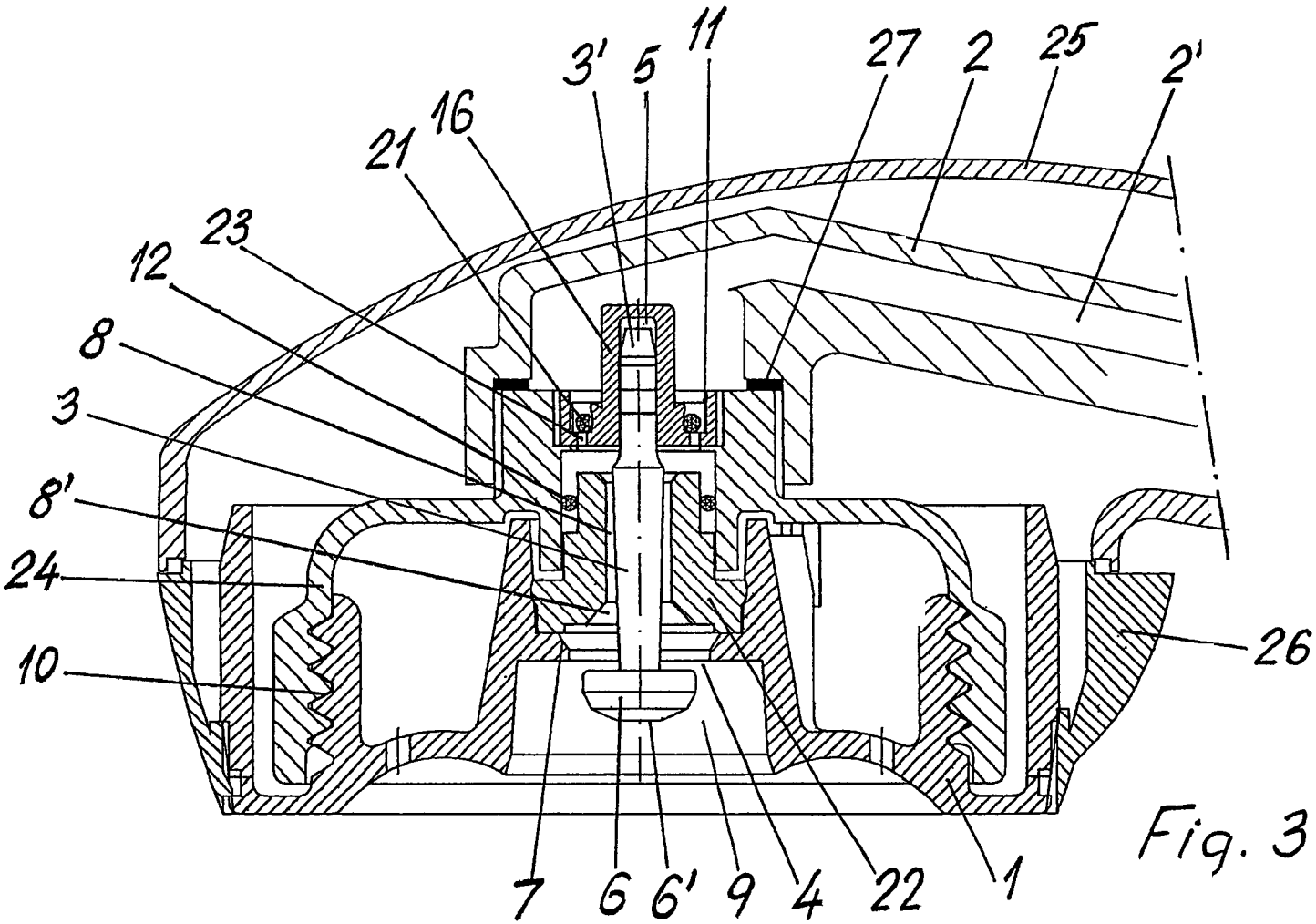

The sectional view shown in the figures shows a channel 2' for water supply through a holder 2, as shown only in a portion closest to the shower head. It is understood that the holder 2 shown in FIG. 1 in a known way may be formed as a handle or provided with means for attaching to a wall holder, possibly as a combination of handle and attachment device. In the embodiments of FIGS. 2 and 3 the holder 2 is an internal element for water supply inside an external encasing 25, which may form a handle, similar to the holder 2 shown in FIG. 1.

The shower head comprises a mouth piece 1, which is screwed into the holder 2 by threads (FIG. 1), or into an internal adapter 24 which is screwed into the holder 2 (FIGS. 2 and 3), respectively. The threads are also used for regulating the axial position of the mouth piece 1 relatively to the holder 2, or the adapter 24, respectively. A stop may be arranged to limit the possibilities for such regulation.

The mouth piece has an internal cavity 9, which is open for water outflow, and which innermost is almost circular. Via an axial channel 8 and holes 23 (FIGS. 1 and 3), 28 (FIG. 2), respectively, in an insert 16, the cavity 9 communicates with the internal channel 2' in the holder 2. In FIG. 1 it is shown via a hole 2'''' in a boss 2''' integral with the holder 2.

A conical surface 7 is in the shown embodiments formed axially inside of the cavity 9 in the mouth piece 1. The surface 7 is shown formed on the mouth piece 1, but it may possibly be on a ring (not shown), which may be made of plastic, and which may be secured in a force fit, but it is also possible to weld on the ring, e.g. by ultrasonic welding, when the mouth piece is made of plastic as well. The ring may also be screwed into threads.

The holder 2 contains the insert 16, which has a bore 5 in the middle, and in the bore 5 there is screwed or pressed in an end 3' of a stem 3. The insert 16 is shown integrated with a regulator formed by axial holes 23 in the insert 16 and an O-ring 21. The insert 16 and the regulator are in FIG. 1 shown mounted in the boss 2''' which is integral with the holder 2, while in FIGS. 2 and 3, they are shown mounted in the adapter 24. The insert 16 is shown formed partially as a pin. In the embodiment shown in FIG. 1 the pin is used for centering and stabilization by being inserted into a hole in the holder 2.

The insert 16 is shown formed with approximately axial grooves 11. In the embodiments shown in FIGS. 1 and 3, the grooves 11 are formed in a circumferential wall in the insert 16, outside the O-ring 21, while in FIG. 2, they are formed in the insert 16 inside of the O-ring 21.

Together the grooves 11 and the O-ring 21 are forming a regulator which attempts to maintain constant water flow per time unit. This takes place in that increasing pressure, which without the regulator would cause increasing amount of water per time unit, presses the O-ring 21 together and partially into the grooves 11, whereby the flow area decreases. Experiments have shown that from a certain minimum pressure an approximately constant amount of water per time unit may be obtained.

In FIG. 1 the O-ring 21 is shown radially inside the grooves 11, situated in the insert 16. In FIG. 2 the O-ring is shown radially outside the grooves 11, and here it is situated in an annular seat in the adapter 24. In FIG. 3 the O-ring is shown radially inside the grooves, situated in the insert 16, almost similarly as shown in FIG. 1.

At its outermost end, in the cavity 9, the stem 3 holds an approximately disc shaped deflection element 6, which on the axial side that faces the channel 8 may be formed with a circumferential groove (not shown) around the end of the stem. Between the circumference of the deflection element 6 and the conical surface 7 there is an annular gap 4, which is altered by the mouth piece 1 being screwed axially relatively to the holder 2 (FIG. 1) or the adapter 24 (FIG. 2). The stem 3 has a smaller diameter than the channel 8, so that water may flow in an annulus between the stem 3 and the wall in the channel 8. The axial external surface 6' at the deflection element 6 is shown dome shaped, but this surface is not considered to have an essential influence on the flow of water.

Together with the deflection element 6 the surface 7 forms an annular chamber, which changes shape and size when the mouth piece 1 is screwed axially relatively to the holder 2, and the chamber influences the water in different ways, depending on its shape and size.

The conical surface 7 does not need to be conical along all its axial length. The surface 7 may be cylindrical or almost cylindrical outermost, towards the cavity 9. The channel 8 may mainly be cylindrical, but closest to the chamber the channel 8 may comprise a conical portion 8'.

The stem 3, at least in the area situated in the innermost portion of the channel 8 (closest to the insert 16), is conical, so that the cross section is largest towards the fixed end 3' of the stem 3. When it is assumed that the channel 8 itself has constant cross section in this area, it is obtained that the flow area for the water innermost in the channel 8 is altered when the mouth piece 1 is screwed axially relatively to the holder 2.

In all the shown embodiments the channel 8 is formed in an inserted plug 22 (shown pressed in), with a sealing ring 12 between the plug 22 and the boss 2''' (FIG. 1) or the adapter 24 (FIGS. 2 and 3), respectively. The ring prevents loss of pressure due to leakage, and also prevents water from entering the shown cavity between the holder 2 and the mouth piece 1 and creating unsanitary environments by water staying in the cavity over time.

When the mouth piece is screwed approximately maximally into the holder 2, and hence the deflection element 6 being approximately in its largest distance from the external outlet of the channel 8, relatively large drops of water are formed with relatively large mutual distance and great velocity, and which leave the deflection element 6 in a conical surface. Some of the water hits the wall in the cavity 9, and the water is reflected from the wall and exits the mouth piece 1 and forms a relatively uniform structure.

When the mouth piece is screwed further out relatively to the holder 2, whereby the deflection element 6 is closer to the channel outlet, there will be an increased choking in the gap 4 at the deflection element 6. This position is useful for low water pressures, as a relatively greater water consumption and a water velocity which feels comfortable are obtained.

When the mouth piece 1 is screwed approximately to its end position away from the holder 2, and hence the deflection element 6 is in maximum proximity to the mouth piece 1, an unstability for the water will occur, which flows out pulsating, and showering feels as a massage.

That the surface 7 surrounding the deflection element 6 mainly is conical and converges outwardly in the mouthpiece, influences the flow course of the water around the deflection element 6.

In the embodiments shown in FIGS. 2 and 3 there is also a sealing ring 27 between the adapter 24 and the holder 2. Moreover, on the encasing 25 there is mounted a hood 26 which closes a gap between the mouth piece 1 and the encasing 25.

It should be appreciated that each component in the shower head may be made of plastic or metal, except for the O-rings 12 and 21, which may be made of synthetic rubber or natural rubber. The holder 2 and the mouth piece 1 may for instance be cast, while it is presumed to be most convenient that the stem 3 and the deflection element 6 are produced in one piece, preferably of metal, e.g. brass, by mechanical machining, i.e. mainly turning and thread cutting.

The insert 16 with the grooves 11 and the holes 23 may also be made of plastic. The holes 23 may be formed by casting, but the holes may also be drilled.

What is claimed is:

1. A shower head comprising a mouth piece including a middle axial through channel fro flow through of water, a rotationally symmetrical deflection element for the water being near the external outlet of the channel, which mouth piece is connected to a holder through which the water is fed, while the deflection element is held by a stem which with radial clearance projects axially in the channel, and is surrounded by a conical surface, the mouth piece limiting a cavity around and axially outside the deflection element, the conical surface projecting convergently outwardly, the stem being secured in an insert mounted in the holder, which insert having at least one through opening fro leading the water to the channel, characterized by the insert forming a regulator for causing an approximately constant amount of water per time unit to flow through at variations of water pressure, and which in a per se known manner comprises a ring member with axial grooves against which an O-ring is in contact, the O-ring being influenced by the water pressure and successively is pressed into the grooves at increasing water pressures.

2. A shower head according to claim 1, in which the regulator comprises a hollow pin to which one end of the stem is fixed.

3. A shower head according to claim 1, in which the O-ring is radially inside or outside the grooves.

4. A shower head according to claim 1, in which the stem is conical at least in the portion being furthest away from the deflection element, whereby the surface of the stem converges towards the deflection element, and whereby the flow area for the water between the stem and the mouth piece is altered by axial movement of the mouth piece relatively to the holder.

* * * * *